US009617879B2

(12) United States Patent
Schnell et al.

(10) Patent No.: US 9,617,879 B2
(45) Date of Patent: Apr. 11, 2017

(54) SWITCHABLE SUPPORT ELEMENT

(71) Applicant: Schaeffler Technologies AG & Co. KG, Herzogenaurach (DE)

(72) Inventors: Oliver Schnell, Veitsbronn (DE); Peter Sailer, Erlangen (DE); Christian Geers, Furth (DE); Ulrich Elgas, Uehlfeld (DE); Rainer Pfeufer, Hagenbuchach (DE); Stefan Weidlich, Hetzles (DE); Dieter Baumgarten, Bamberg (DE); Armin Liebel, Weissenohe (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/888,981

(22) PCT Filed: Feb. 26, 2014

(86) PCT No.: PCT/DE2014/200080

§ 371 (c)(1),
(2) Date: Nov. 4, 2015

(87) PCT Pub. No.: WO2014/183749

PCT Pub. Date: Nov. 20, 2014

(65) Prior Publication Data

US 2016/0090879 A1 Mar. 31, 2016

(30) Foreign Application Priority Data

May 15, 2013 (DE) ..... 10 2013 209 026

(51) Int. Cl.

| | |
|---|---|
| ***F01L 1/18*** | (2006.01) |
| ***F01L 13/00*** | (2006.01) |
| ***F01L 1/14*** | (2006.01) |

(52) U.S. Cl.
CPC ..... *F01L 13/0015* (2013.01); *F01L 1/14* (2013.01); *F01L 13/0005* (2013.01); *F01L 2107/00* (2013.01)

(58) Field of Classification Search
CPC ..... F01L 13/0015; F01L 1/14; F01L 13/0005; F01L 2107/00
See application file for complete search history.

(56) References Cited

U.S. PATENT DOCUMENTS

| | | | | |
|---|---|---|---|---|
| 4,509,467 | A | 4/1985 | Arai et al. | |
| 6,615,783 | B2 * | 9/2003 | Haas | F01L 1/146 123/90.35 |

(Continued)

FOREIGN PATENT DOCUMENTS

| | | |
|---|---|---|
| DE | 10204672 | 8/2003 |
| DE | 102008048926 | 4/2009 |
| DE | 10 2008052279 | 4/2010 |

*Primary Examiner* — Zelalem Eshete
(74) *Attorney, Agent, or Firm* — Volpe and Koenig, P.C.

(57) ABSTRACT

A switchable support element (1) for a valve train of an internal combustion engine is disclosed, including a housing (4), in the bore of which (5) an axially displaceable inner element (7) is located, wherein two coupling slides (9) run in a radial bore (8) of the inner element (7) and can be brought into engagement with a driver surface of the housing (4) in an axially extended position, wherein the extended position is limited by a height stop (10), which is formed of a circlip assembly, which runs peripherally on an annular shoulder (13) of the inner element (7) and which, in the event of contact, lies radially externally above the upper annular end (14) thereof in abutment against a lower annular edge (15) of an annular groove (16) of the housing (4) near the upper edge thereof (17), and wherein an outer casing (11) of the housing is enclosed by a rotationally fixed ring as an outer anti-twist mechanism (12) with an offset bore (18).

6 Claims, 1 Drawing Sheet

(56) References Cited

U.S. PATENT DOCUMENTS

| | | | |
|---|---|---|---|
| 7,210,439 | B2 | 5/2007 | Geyer et al. |
| 2009/0095240 | A1 | 4/2009 | Roerig et al. |
| 2009/0199805 | A1 | 8/2009 | Hendriksma |
| 2011/0271924 | A1 | 11/2011 | Heinemann et al. |

* cited by examiner

SWITCHABLE SUPPORT ELEMENT

BACKGROUND

The invention relates to a switchable support element for a valve train of an internal combustion engine, with a housing that can be installed in a receptacle of a cylinder head of the internal combustion engine and in whose bore hole there is an axially moving inner element that receives a force applied by a spring element pushing this inner element outward from the housing, wherein at least one coupling slide runs in a radial bore hole of the inner element, wherein this coupling slide can be brought into engagement in an axially extended position with a driving surface of the housing, wherein the extended position is limited by a height stop and wherein a projection extends past an outer casing of the housing for forming an outer anti-rotation lock.

The closest prior art is considered to be DE 10 2008 048 926 A1. There is a multifunctional clip in the outer casing of the housing. This clip extends past the previously mentioned outer casing with a sickle-shaped partial area for forming the outer anti-rotation lock. The anti-rotation lock is necessary to create a directed feeding of hydraulic medium to the support element and/or to align the radial bore hole of the support element with the coupling piston with respect to the surrounding construction.

At the same time, a height stop is realized by the clip mentioned above [that guarantees coupling play] through contact on an annular shoulder of the inner element and an inner anti-rotation lock.

The clip is broken off in the event of operation with enormous loads. In addition, someone skilled in the art knows that the already thin-wall inner element is weakened due to the formation of the inner anti-rotation lock (longitudinal flattened sections) and also loses guide and sealing length. A simple adjustment of the axially extended position of the inner element [coupling play] is also not possible, because the clip must be disassembled again after fixing an actual play.

In addition, switchable support elements are previously known whose outer anti-rotation lock is realized by means of a pin sitting in a window of the housing. Under some circumstances, the pin can become loose during operation. In addition, the housing can become deformed during its assembly.

Therefore, a switchable support element must be created in which the disadvantages mentioned above are not observed.

SUMMARY

According to the invention, this objective is achieved in that, as the height stop, there is at least one surrounding circlip on an annular shoulder of the inner element, wherein this circlip contacts a lower annular edge of an annular groove of the housing at its upper edge radially outward over its upper annular end in the contact case, wherein the outer casing of the housing is surrounded by a rotationally fixed ring or ring segment as the outer anti-rotation lock with offset bore hole for installation in a complementary counter contour of the receptacle of the cylinder head.

Thus, a support element of the class specified above is provided, in which the described disadvantages are no longer observed. The at least one circlip, possibly with stress-reducing wave profile on its outer casings, can be assembled very easily. The inner element has sufficient guide and sealing length. At the same time, a simple outer anti-rotation lock is provided by the ring applied on the outer casing of the housing with offset bore hole. This arrangement thus creates a functional separation in comparison with the prior art described above.

The outer anti-rotation lock can also sit at least partially in an annular groove of the outer casing of the housing and can have geometries, such as multi-sided, deviating from the ring shape.

The ring/ring segment is held in an especially preferred way in an upper section of the housing, so that the counter contour of the cylinder head extends from its upper side only with low depth.

To align the support element with the ring/ring segment, rotational orientation is provided. Thus, a tongue projects from this element radially inward through a cut section of the housing, wherein this tongue runs with its lateral outer sides in front of legs of the cut section. At the same time, the projecting ring can be used for attaching a handling tool during assembly or for transport/packaging of the support element. To someone skilled in the art it is clear that the rotationally oriented attachment of the ring/ring segment is not necessary during operation to provide the outer anti-lock rotation to the support element itself (eccentric bore hole of the ring/ring segment).

By means of the at least one circlip it is provided in a realization of the invention to form an inner anti-rotation lock, that is, rotational lock of the inner element relative to the housing. Here, the circlip has, on its inner edge, a chord-like flattened section that interacts with a flat section on the outer casing of the inner element.

It is advantageous to install exactly two circlips, wherein only the upper circlip is used for fine adjustment of the coupling play. For a more detailed explanation of the adjustment of the coupling play, refer to the known prior art (see DE 102 04 672 A1, as well as the description).

For use of exactly two coupling slides that are then diametrically opposite each other, wherein also a coupling slide assembly is conceivable, an introduction of low loading forces is guaranteed in the coupling case. Tilting is excluded or reduced. Preferably, the axial line of the coupling slides is aligned parallel to the cylinder head longitudinal direction or, in other words, in the camshaft direction.

The measures according to the invention can also be used for roller tappets.

BRIEF DESCRIPTION OF THE DRAWINGS

The invention can be seen in the drawing. Shown are.

DETAILED DESCRIPTION OF THE PREFERRED EMBODIMENTS

Figure 1:
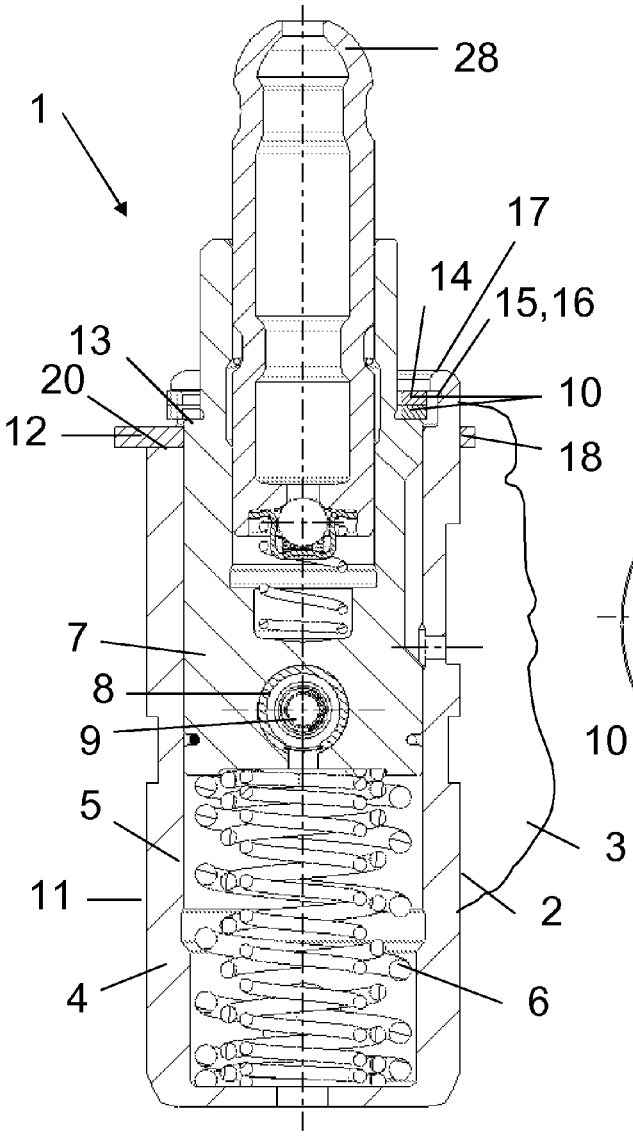
FIG. 1, a longitudinal section through a switchable support element, perpendicular to its coupling slides, FIG. 2, a top view of the support element, and FIG. 3, an enlarged view of the outer ring with tongue.

In FIG. 1, a switchable support element 1 for a valve train of an internal combustion engine is shown perpendicular to its two coupling slides 9 (see DE 102 04 672 A1) so that these cannot be seen in more detail in their longitudinal extent within their radial bore hole 8.

The support element 1 has a sheet-metal pot-shaped housing 4 that is installed in a receptacle 2 shown here in a cylinder head 3 of the internal combustion engine. An axially moving inner element 7 with a head 28 moves in a bore hole 5 of the housing 4 and is loaded by a spring element 6 (helical compression spring assembly) out of the housing 4. The head is used for one-end support of a cam follower.

The coupling slides 9 are diametrically opposite each other in the radial bore hole 8. They engage in the shown, axially extended position of the inner element 7 with a driving surface of the housing 4, so that the valve is lifted.

The extended position is limited by a height stop 10 that is here made from two circlips. These circlips run on an annular shoulder 13 of the inner element 7, wherein the upper circlip of the circlip assembly 10 contacts a lower annular edge 15 of an annular groove 16 of the housing 4 radially on the outside in some sections over its upper annular end 14 for its head-side, upper edge 17. For installation and adjustment of the coupling clearance, only the upper circlip of the circlip assembly 10 is provided in pairs grouped by thickness.

It can be seen that an outer casing 11 of the housing 4 is surrounded by a ring 12 that is punched from steel sheet as an outer anti-rotation lock. The ring 12 has an offset bore hole 18 as can be seen in more detail from FIG. 3 in connection with FIGS. 1, 2. The receptacle 2 of the cylinder head 3 has a counter contour complementary to the ring 12. In this way, the support element 1 is secured against twisting relative to the receptacle 2.

Equally, the ring 12 has a twisting-oriented attachment relative to the outer casing 11 of the housing 4. Here, a tongue 9 projects radially inward through a cut section 20 of the housing 4. The tongue 19 runs with its lateral outer sides 21 in front of legs 22 of the cut section 20.

Figure 2:
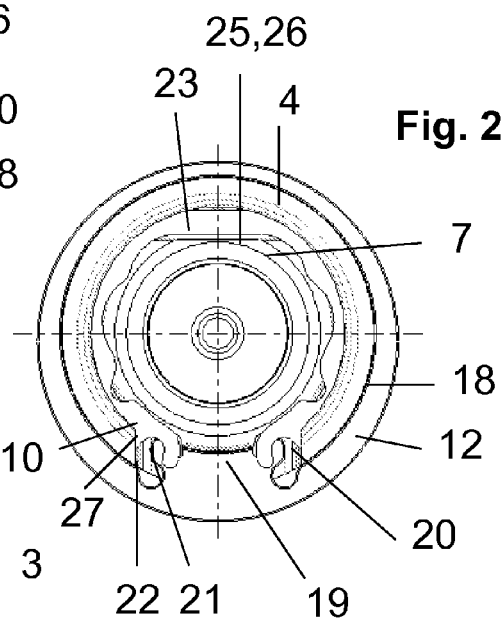
Figure 3:
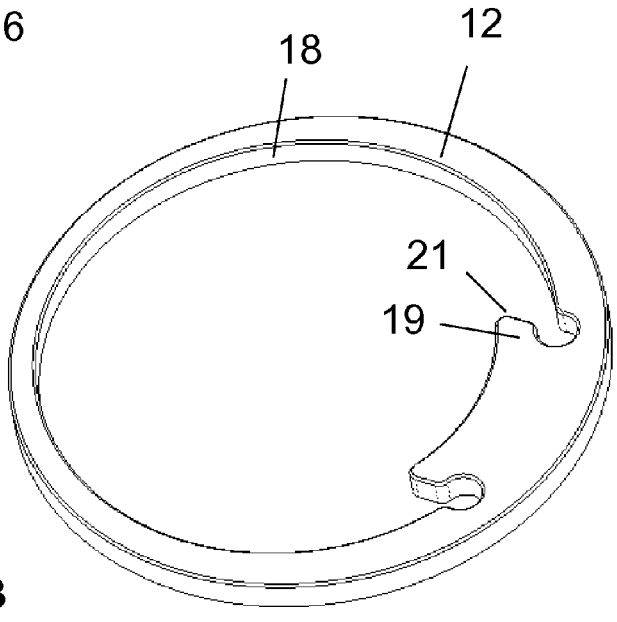

Finally, from FIG. 2 it can be seen that the upper circlip 10 has, on its inner edge 23, a flattened section 24 that communicates with an opposing flat section 26 on the outer casing 25 of the inner element 7. Free ends 27 of the circlip 10 contact legs 22 of the cut section 20 of the housing 4 angled radially outward. In this way, an inner anti-rotation lock is formed. It can be seen from FIG. 1 that both circlips 10 are flattened (for reference number 14).

LIST OF REFERENCE NUMBERS

1) Switchable support element
2) Receptacle
3) Cylinder head
4) Housing
5) Bore hole
6) Spring means
7) Inner element
8) Radial bore hole
9) Coupling slide
10) Height stop means, circlip
11) Outer casing
12) Outer anti-rotation lock, ring
13) Annular shoulder
14) Annular end
15) Lower annular edge
16) Annular groove
17) Upper edge
18) Bore hole
19) Tongue
20) Cut section
21) Outer side
22) Leg
23) Inner edge
24) Flattened section
25) Outer casing
26) Flat section
27) End
28) Head

The invention claimed is:

1. A switchable support element for a valve train of an internal combustion engine, comprising a housing that is installable in a receptacle of a cylinder head of the internal combustion engine having a bore hole in which an axially moving inner element is located that receives a force applied by a spring element pushing said inner element outward from the housing, at least one coupling slide runs in a radial bore hole of the inner element, said at least one coupling slide is brought into engagement in an axially extended position of the inner element with a driving surface of the housing, and the axially extended position is limited by a height stop, a projection extends past an outer casing of the housing to form an outer anti-rotation lock, the height stop includes at least one circlip that surrounds an annular shoulder of the inner element and contacts a lower annular edge of an annular groove of the housing at an upper edge thereof radially outward past an upper annular end in the contact case, and the outer casing of the housing is surrounded by a rotationally fixed ring or ring segment as the outer anti-rotation lock with an offset bore hole for installation in a complementary counter contour of the receptacle of the cylinder head.

2. The support element according to claim 1, wherein for forming the rotationally fixed attachment of the ring or ring segment, a tongue projects radially inward from the ring or ring segment through a cut section of the housing, and the tongue runs with lateral outer sides thereof in front of or on legs of the cut section.

3. The support element according to claim 2, wherein the ring or ring segment is locally separated by the height stop and runs directly axially underneath the height stop, and the cut section is open for the tongue from the upper edge of the housing.

4. The support element according to claim 1, wherein exactly two of the circlips are used.

5. The support element according to claim 4, wherein only an upper one of the circlips of the two circlips is provided grouped with respect to a thickness thereof for installation for defining the axially extended position of the inner element out of the housing.

6. The support element according to claim 1, wherein the circlip has, on an inner edge thereof, a flattened section that interacts with an opposing flat section on an outer casing of the inner element, and free ends of the circlip contact legs of a cut section of the housing bent radially outward, to form an inner anti-rotation lock.

* * * * *